US007066720B2

(12) United States Patent
Cheng et al.

(10) Patent No.: US 7,066,720 B2
(45) Date of Patent: Jun. 27, 2006

(54) FAN HOUSING

(75) Inventors: Jui-Hung Cheng, Kaohsiung (TW); Chih-Sheng Yang, Kaohsiung (TW)

(73) Assignee: Asia Vital Components Co., Ltd. (TW)

( * ) Notice: Subject to any disclaimer, the term of this patent is extended or adjusted under 35 U.S.C. 154(b) by 303 days.

(21) Appl. No.: 10/459,633

(22) Filed: Jun. 11, 2003

(65) Prior Publication Data

US 2004/0253128 A1 Dec. 16, 2004

(51) Int. Cl.
*F04B 17/00* (2006.01)

(52) U.S. Cl. ..... 417/423.3; 417/423.7; 417/423.14; 417/361

(58) Field of Classification Search ..... 417/423.3, 417/423.7, 423.14; 361/695
See application file for complete search history.

(56) References Cited

U.S. PATENT DOCUMENTS 5,189,327 A * 2/1993 Ootsuka et al. ..... 310/71
6,053,242 A * 4/2000 Hsieh ..... 165/121
6,071,082 A * 6/2000 Lecinski et al. ..... 417/53
6,174,145 B1 * 1/2001 Taniguchi ..... 417/423.14

* cited by examiner

*Primary Examiner*—Tae Jun Kim
*Assistant Examiner*—Ryan P. Gillan
(74) *Attorney, Agent, or Firm*—Brinks Hofer Gilson & Lione

(57) ABSTRACT

In a fan housing, a surrounding wall extends uprightly from an inner surface of a base wall that is formed with a wire hole. A power wire, which is coupled to a fan motor mounted on the inner surface, extends through the wire hole. A wire-positioning unit includes a first positioning groove formed in an outer surface of the base wall and extending from the wire hole to the surrounding wall, a second positioning groove formed in an outer surrounding surface of the surrounding wall and extending from the first positioning groove such that the power wire extends along the first and second positioning grooves, a first anchoring member for anchoring the power wire in the first positioning groove, and a second anchoring member for anchoring the power wire in the second positioning groove.

2 Claims, 5 Drawing Sheets

FAN HOUSING

BACKGROUND OF THE INVENTION

1. Field of the Invention

The invention relates to a fan housing, more particularly to a fan housing capable of securely anchoring a power wire therein.

2. Description of the Related Art

FIG. 1 illustrates a conventional heat dissipating fan device that includes a fan housing 3, and a fan 2 mounted in the fan housing 3. The fan housing 3 includes a base wall 31, and a surrounding wall 33 extending uprightly from the base wall 31. The base wall 31 is formed with a wire-positioning groove 331 such that a power wire 21 coupled to a fan motor (not shown) can extend along the wire-positioning groove 331. The base wall 31 is further formed with a slot 332 extending from a periphery thereof to the wire-positioning groove 331 so as to permit the power wire 21 extending along the wire-positioning groove 331 to further extend through the slot 332. The slot 332 has opposite lateral sides. An anchoring tab 333 extends from one of the lateral sides and toward the other of the lateral sides for anchoring the power wire 21 in the slot 332.

In practice, even with the presence of the wire-positioning groove 331 and the anchoring tab 333, secure anchoring of the power wire 21 cannot be ensured since the power wire 21 can still slip off easily from the slot 332.

SUMMARY OF THE INVENTION

Therefore, the object of the present invention is to provide a fan housing capable of securely anchoring a power wire therein.

According to the present invention, a fan housing comprises:

a base wall having opposite inner and outer surfaces and formed with a wire hole through the inner and outer surfaces, the base wall being adapted to be mounted with a fan motor on the inner surface, a power wire coupled to the fan motor being adapted to extend from the inner surface to the outer surface through the wire hole;

a surrounding wall extending uprightly from the inner surface of the base wall and having an outer surrounding surface; and a wire-positioning unit provided on the outer surface of the base wall and the outer surrounding surface of the surrounding wall, the wire-positioning unit including a first positioning groove formed in the outer surface of the base wall and extending from the wire hole in the base wall to the surrounding wall, a second positioning groove formed in the outer surrounding surface of the surrounding wall and extending from the first positioning groove such that the power wire extending through the wire hole is adapted to extend along the first and second positioning grooves, a first anchoring member formed on the outer surface of the base wall and extending across the first positioning groove for anchoring the power wire in the first positioning groove, and a second anchoring member formed on the outer surrounding surface of the surrounding wall and extending across the second positioning groove for anchoring the power wire in the second positioning groove.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
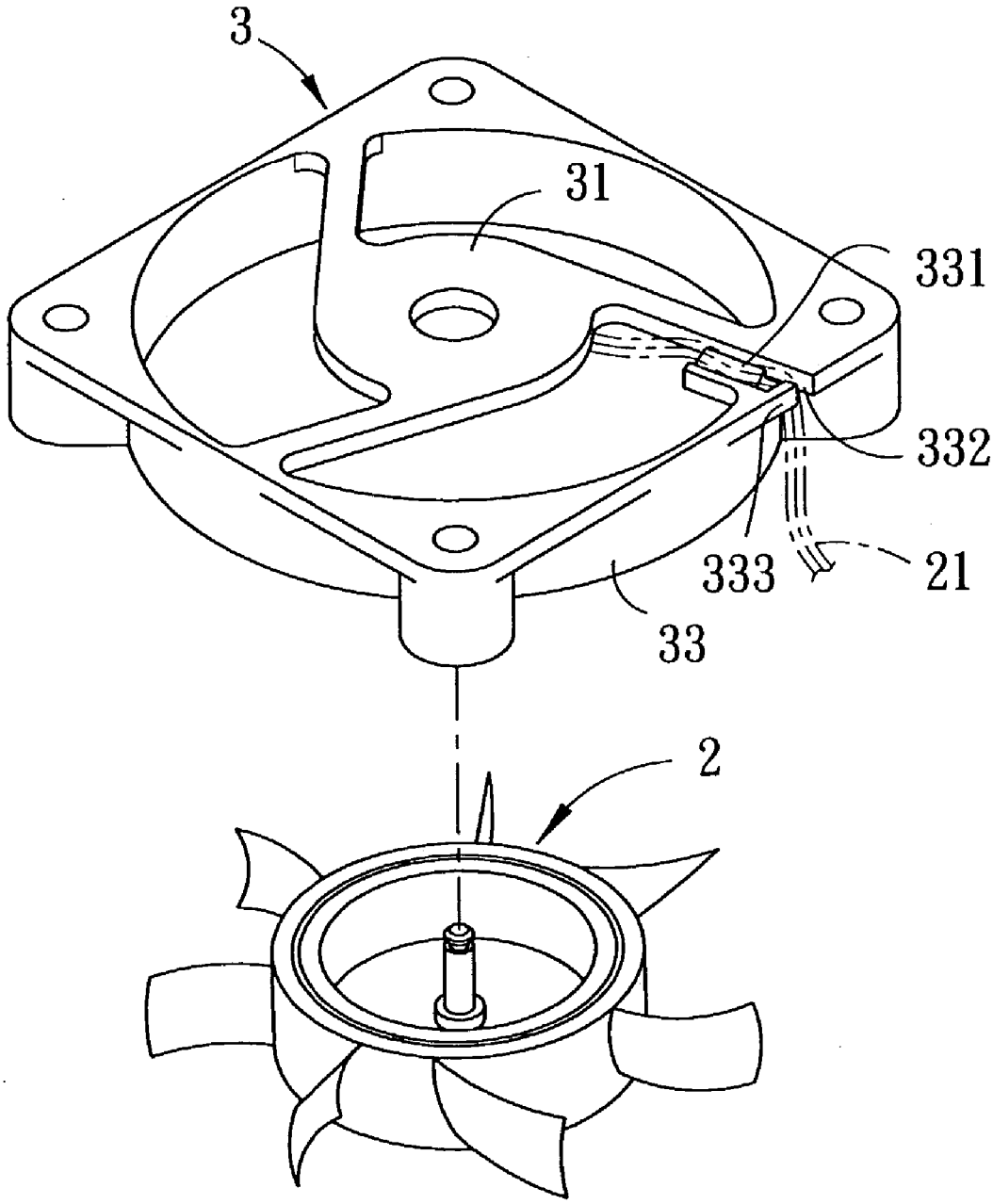
FIG. 1 PRIOR ART
FIG. 1 is a perspective view of a conventional fan device.
Figure 2:
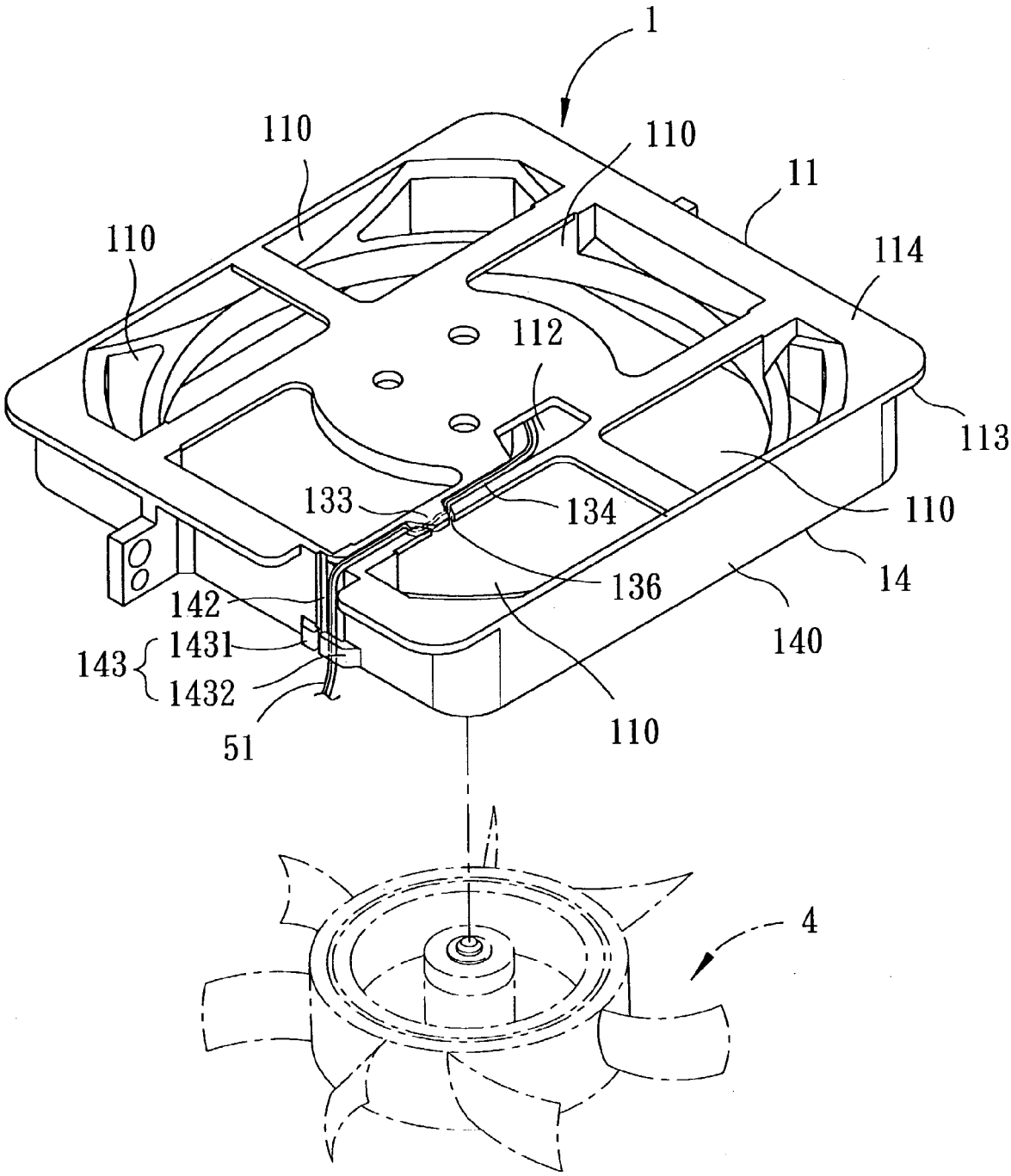
FIGS. 2 and 3 are perspective views showing the preferred embodiment of a fan housing according to the present invention.
Figure 3:
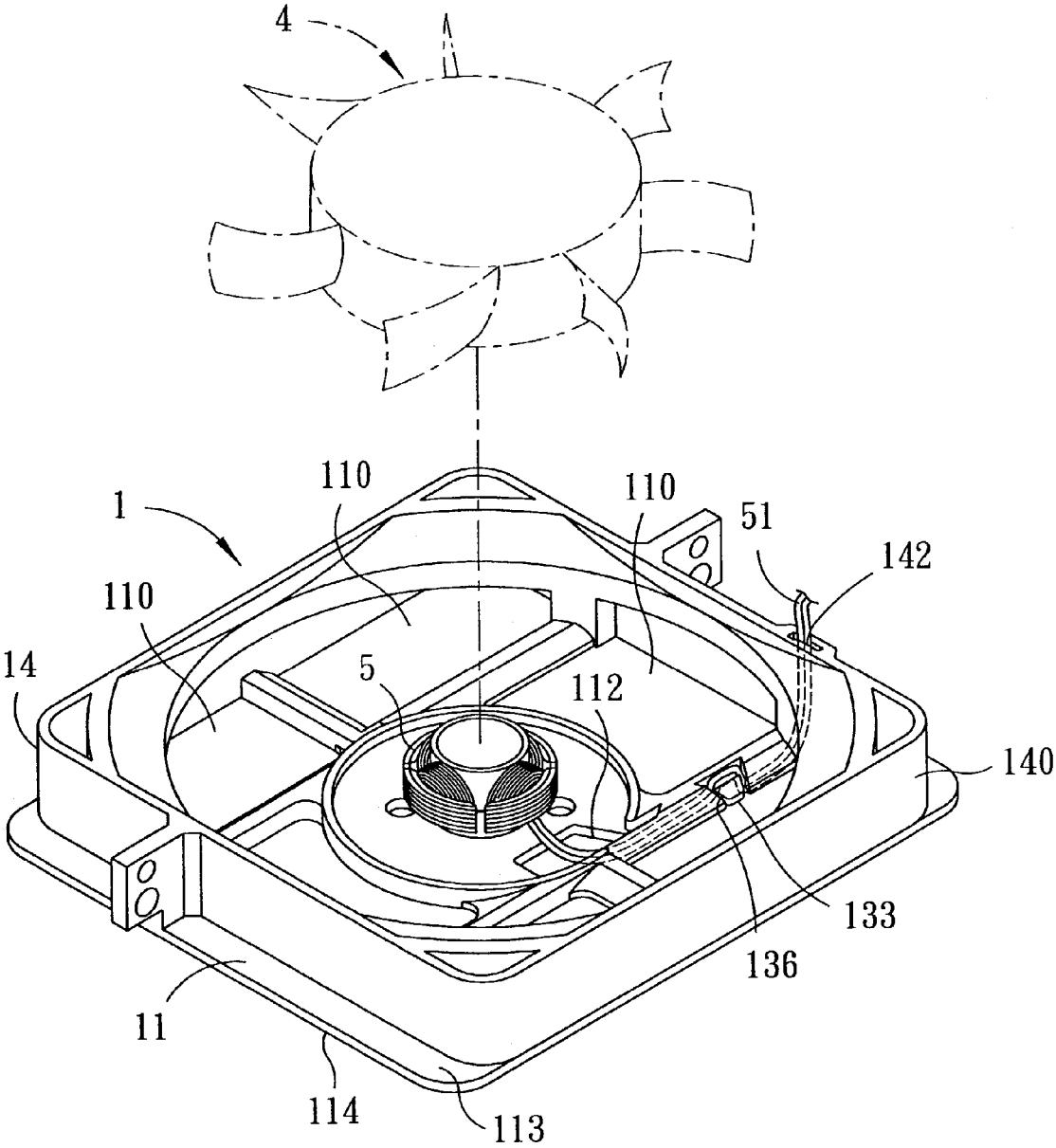

Referring to FIGS. 2 and 3, the preferred embodiment of a fan housing 1 according to the present invention is shown to include base wall 11, a surrounding wall 14, and a wire-positioning unit.

The base wall 11 has opposite inner and outer surfaces 113, 114, and is formed with a wire hole 112 and a plurality of vent holes 110 through the inner and outer surfaces 113, 114. The base wall 11 is adapted to be mounted with a fan motor 5 for driving a fan impeller 4 on the inner surface 113. A power wire 51 coupled to the fan motor 5 is adapted to extend from the inner surface 113 to the outer surface 114 through the wire hole 112.

The surrounding wall 14 extends uprightly from the inner surface 113 of the base wall 11, and has an outer surrounding surface 140.

Figure 4:
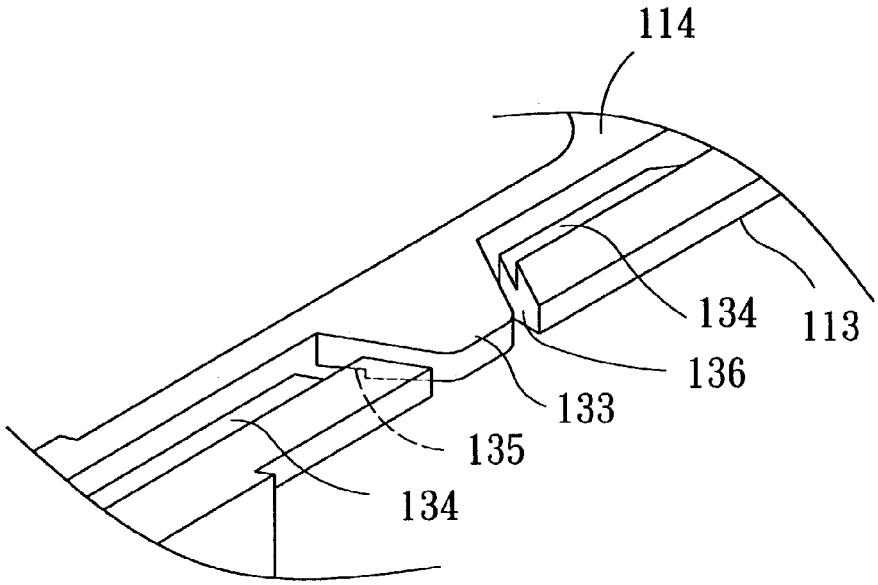
FIG. 4 is a fragmentary perspective view showing a first positioning groove and a first anchoring member of the preferred embodiment.
Figure 5:
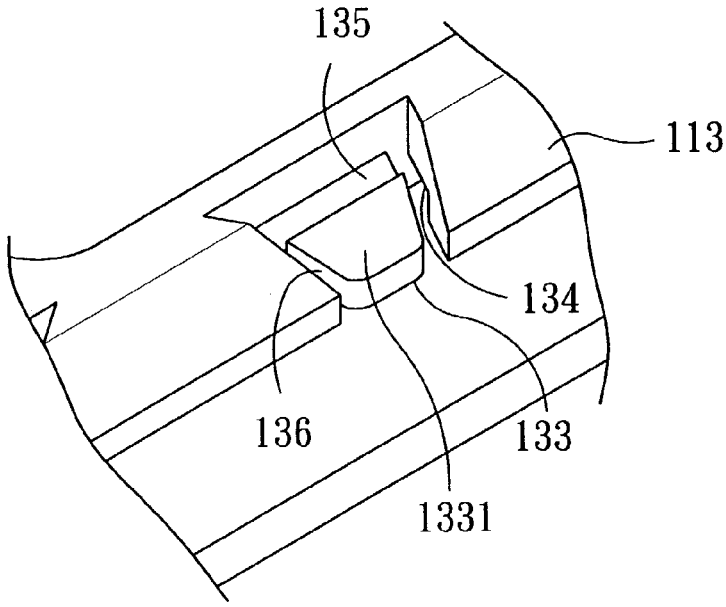
FIG. 5 is a fragmentary perspective view showing the first anchoring member in FIG. 4.
Figure 6:
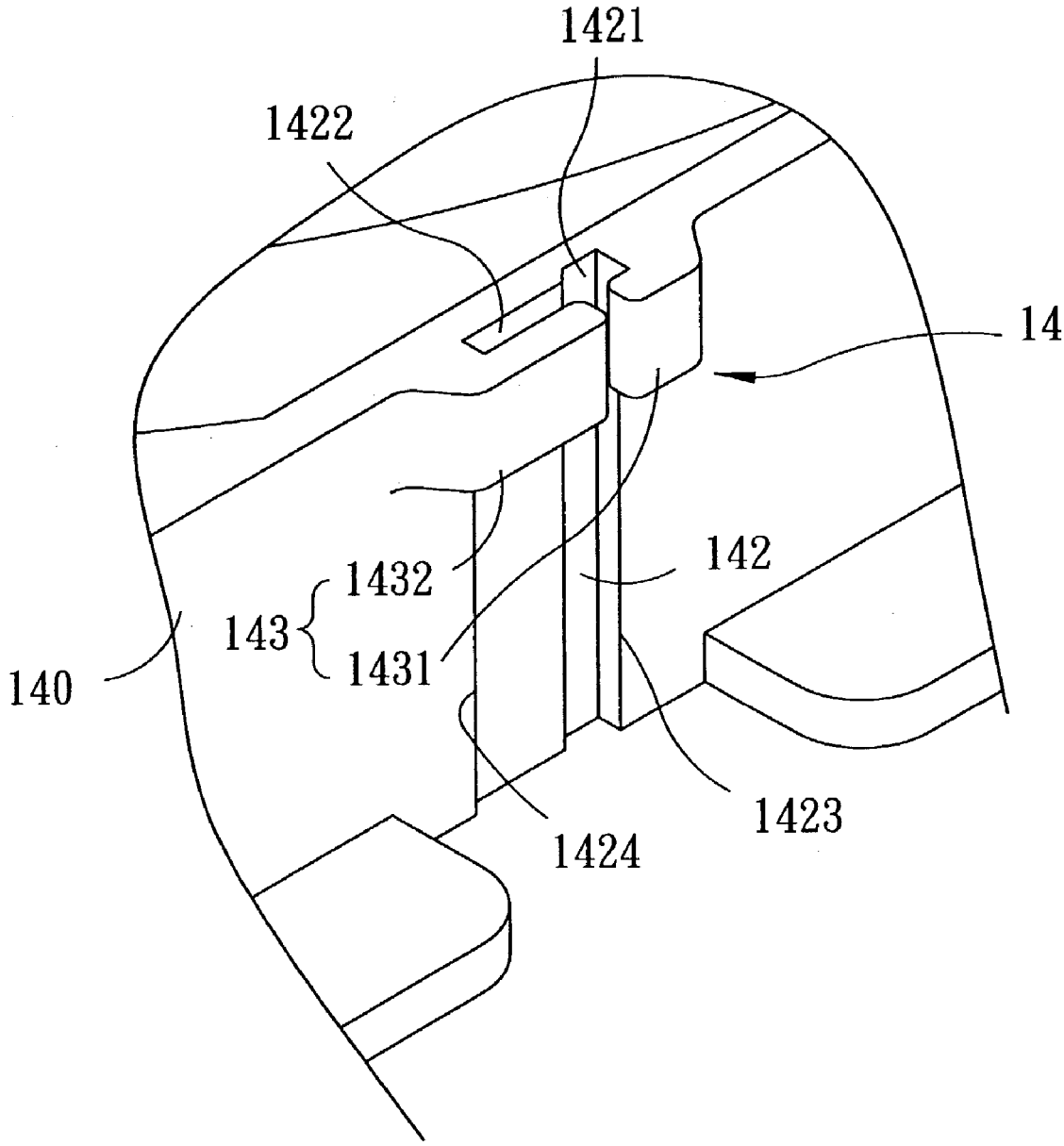
FIG. 6 is a fragmentary perspective view showing a second positioning groove and a second anchoring member of the preferred embodiment.

The wire-positioning unit is provided on the outer surface 114 of the base wall 11 and the outer surrounding surface 140 of the surrounding wall 14. The wire-positioning unit includes a first positioning groove 134, a first anchoring member 133, a second positioning groove 142, and a second anchoring member 143. The first positioning groove 134 is formed in the outer surface 114 of the base wall 11, and extends from the wire hole 112 in the base wall 11 to the surrounding wall 14, as best shown in FIG. 2. Referring further to FIGS. 4 and 5, the first anchoring member 133 is formed on the outer surface 114 of the base wall 11 and extends across the first positioning 134 for anchoring the power wire 51 in the first positioning groove 134, as shown in FIG. 2. In this embodiment, the base wall 11 further has a guiding hole 136 formed through the inner and outer surfaces 113, 114 and communicated with one of the vent holes 110 (see FIG. 2). The guiding hole 136 interrupts the first positioning groove 134, and is registered with the first anchoring member 133 (see FIG. 4). The guiding hole 136 has an area larger than that of the first anchoring member 133. The first anchoring member 133 has a surface 1331 facing toward the inner surface 113 of the base wall 11 and formed with a third positioning groove 135 (see FIG. 5) that is parallel to the first positioning groove 134 (see FIG. 4) and that permits the power wire 51 extending along the first positioning groove 134 to further extend along the third positioning groove 135 (see FIG. 3). Referring to FIGS. 2 and 6, the second positioning groove 142 is formed in the outer surrounding surface 140 of the surrounding wall 14, and extends from the first positioning groove 134 such that the power wire 51 extending from the wire hole 112 is adapted to extend along the first, second and third positioning grooves 134, 142, 135, as shown in FIG 2. In this embodiment, the second positioning groove 142 has a deeper guiding portion 1421 and a shallower anchoring portion 1422 parallel and adjacent to the guiding portion 1421, as shown in FIG. 6. The second anchoring member 143 is formed on the outer surrounding surface 140 of the surrounding wall 14, and extends across the second positioning groove 142 for anchoring the power wire 51 in the second positioning groove 142. In this embodiment, the second anchoring member 143 includes a guiding tab 1431 that extends from a first lateral side 1423 of the second positioning groove 142 and across the guiding portion 1421, and an anchoring tab 1432 that extends from a second lateral side 1424 of the second positioning groove 142 opposite to the first lateral side 1423 and across the anchoring portion 1422, as shown in FIG. 6. The positioning and anchoring tabs 1431, 1432 extend toward each other. As such, the power wire 51 is adapted to be extended along the guiding portion 1421 and to be anchored in the anchoring portion 1422 by the anchoring tab 1431.

To sum up, due to the presence of the wire-positioning unit, the power wire 51 can be securely anchored on the fan housing 1 of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A fan housing comprising:

a base wall having opposite inner and outer surfaces and formed with a wire hole through said inner and outer surfaces, said base wall being adapted to be mounted with a fan motor on said inner surface, a power wire coupled to the fan motor being adapted to extend from said inner surface to said outer surface through said wire hole;

a surrounding wall extending uprightly from said inner surface of said base wall and having an outer surrounding surface; and a wire-positioning unit provided on said outer surface of said base wall and said outer surrounding surface of said surrounding wall, said wire-positioning unit including a first positioning groove formed in said outer surface of said base wall and extending from said wire hole in said base wall to said surrounding wall, a second positioning groove formed in said outer surrounding surface of said surrounding wall and extending from said first positioning groove such that the power wire extending through said wire hole is adapted to extend along said first and second positioning grooves, a first anchoring member formed on said outer surface of said base wall and extending across said first positioning groove for anchoring the power wire in said first positioning groove, wherein said first anchoring member has a surface facing toward said inner surface of said base wall and formed with a third positioning groove that is parallel to said first positioning groove and that permits the power wire extending alone said positioning groove to further extend along said third positioning groove, and a second anchoring member formed on said outer surrounding surface of said surrounding wall and extending across said second positioning groove for anchoring the power wire in said second positioning groove.

2. A fan housing comprising:

a base wall having opposite inner and outer surfaces and formed with a wire hole through said inner and outer surfaces, said base wall being adapted to be mounted with a fan motor on said inner surface, a power wire coupled to the fan motor being adapted to extend from said inner surface to said outer surface through said wire hole;

a surrounding wall extending uprightly from said inner surface of said base wall and having an outer surrounding surface; and a wire-positioning unit provided on said outer surface of said base wall and said outer surrounding surface of said surrounding wall, said wire-positioning unit including a first positioning groove formed in said outer surface of said base wall and extending from said wire hole in said base wall to said surrounding wall, a second positioning groove formed in said outer surrounding surface of said surrounding wall and extending from said first positioning groove such that the power wire extending through said wire hole is adapted to extend along said first and second positioning grooves, a first anchoring member formed on said outer surface of said base wall and extending across said first positioning groove for anchoring the power wire in said first positioning groove, and a second anchoring member formed on said outer surrounding surface of said surrounding wall and extending across said second positioning groove for anchoring the power wire in said second positioning groove, wherein said second positioning groove has a deeper guiding portion and a shallower anchoring portion parallel and adjacent to said guiding portion, said second anchoring member including a guiding tab that extends from a first lateral side of said second positioning groove and across said guiding portion, and an anchoring tab that extends from a second lateral side of said positioning groove opposite to said first lateral side and across said anchoring portion, said positioning and anchoring tabs extending toward each other, the power wire being adapted to be extended along said guiding portion and to be anchored in said anchoring portion by said anchoring tab.

* * * * *